US011077662B2

(12) United States Patent
Mizuno

(10) Patent No.: US 11,077,662 B2
(45) Date of Patent: Aug. 3, 2021

(54) LIQUID DISCHARGE HEAD

(71) Applicant: Brother Kogyo Kabushiki Kaisha, Nagoya (JP)

(72) Inventor: Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 69 days.

(21) Appl. No.: 16/709,447

(22) Filed: Dec. 10, 2019

(65) Prior Publication Data

US 2020/0247124 A1 Aug. 6, 2020

(30) Foreign Application Priority Data

Jan. 31, 2019 (JP) ..... JP2019-015453

(51) Int. Cl.
*B41J 2/14* (2006.01)

(52) U.S. Cl.
CPC ..... *B41J 2/1433* (2013.01)

(58) Field of Classification Search
CPC ..... B41J 2/14; B41J 2/1433; B41J 2/14032
See application file for complete search history.

(56) References Cited

U.S. PATENT DOCUMENTS

| | | | | |
|---|---|---|---|---|
| 9,193,162 | B2 | 11/2015 | Owaki et al. | |
| 2012/0182354 | A1* | 7/2012 | Akahane | B41J 2/045 347/54 |
| 2015/0165767 | A1 | 6/2015 | Owaki et al. | |
| 2019/0299611 | A1* | 10/2019 | Uchida | B41J 2/14233 |
| 2020/0269574 | A1* | 8/2020 | Tsukahara | B41J 2/14233 |

FOREIGN PATENT DOCUMENTS

| | | |
|---|---|---|
| JP | 2013-230659 A | 11/2013 |
| JP | 2015-101034 A | 6/2015 |
| JP | 2015-116707 A | 6/2015 |

* cited by examiner

*Primary Examiner* — Scott A Richmond
(74) *Attorney, Agent, or Firm* — Banner & Witcoff, Ltd.

(57) ABSTRACT

There is provided a liquid discharge head including: a plurality of pressure chambers aligned in a first direction so as to form first and second pressure chamber groups arranged side by side in a second direction crossing the first direction; a first common channel communicating with pressure chambers constructing the first pressure chamber group; a second common channel communicating with pressure chambers constructing the second pressure chamber group; a first connecting channel connecting one end in the first direction of the first common channel and one end in the first direction of the second common channel; and a second connecting channel connecting the other end in the first direction of the first common channel and the other end in the first direction of the second common channel. Each of the first and second connecting channels overlaps, in a third direction, with any one of the plurality of pressure chambers.

19 Claims, 7 Drawing Sheets

LIQUID DISCHARGE HEAD

CROSS REFERENCE TO RELATED APPLICATION

The present application claims priority from Japanese Patent Application No. 2019-015453 filed on Jan. 31, 2019, the disclosure of which is incorporated herein by reference in its entirety.

BACKGROUND

Field of the Invention

The present disclosure relates to a liquid discharge head provided with two pressure chamber groups, and two common channels provided with respect to the two pressure chamber groups, respectively.

Description of the Related Art

There is a known liquid discharge head provided with two pressure chamber groups each of which is constructed of a plurality of pressure chambers aligned in a X direction (first direction), and two manifolds which are provided with respect to the two pressure chamber groups, respectively. In the publicly known liquid discharge head, the two manifolds are communicated with each other at one ends and the other ends thereof, respectively, in the X direction. In other words, there are provided a first connecting channel which connects the one ends in the X direction of the two manifolds, respectively, with each other, and a second connecting channel which connects the other ends in the X direction of the two manifolds, respectively, with each other. The first connecting channel is communicated with an inflow channel via which an ink is supplied to the two manifolds, and the second connecting channel is communicated with an outflow channel via which the ink is caused to flow out from the two manifolds. The first and second connecting channels are provided respectively on one side and the other side in the X direction, with respect to the plurality of pressure chambers.

In the above-described configuration, it is possible to circulate a liquid such as the ink along the first and second connecting channels and the two manifolds. However, the size of the liquid discharge head is great in the X direction (first direction) since the first and second connecting channels are positioned on the one side and the other side, respectively, in the X direction (first direction), with respect to the plurality of pressure chambers.

An object of the present disclosure is to provide a liquid discharge head capable of realizing a liquid circulation along the connecting channels and the common channels, while suppressing the increase in the size of the liquid discharge head in the first direction.

SUMMARY

According to an aspect of the present disclosure, there is provided a liquid discharge head including: a plurality of pressure chambers forming a first pressure chamber group and a second pressure chamber group, the first pressure chamber group including a part of the pressure chambers aligned in a first direction, and the second pressure chamber group including another part of the pressure chambers aligned in the first direction and arranged side by side relative to the first pressure chamber group in a second direction crossing the first direction; a first common channel extending in the first direction and communicating with the part of the pressure chambers belonging to the first pressure chamber group; a second common channel extending in the first direction, communicating with the another part of the pressure chambers belonging to the second pressure chamber group, and arranged side by side relative to the first common channel in the second direction; a first connecting channel connecting one end in the first direction of the first common channel and one end in the first direction of the second common channel; and a second connecting channel connecting the other end in the first direction of the first common channel and the other end in the first direction of the second common channel. Each of the first connecting channel and the second connecting channel overlaps, in a third direction orthogonal to both of the first and second directions, with one of the plurality of pressure chambers.

DESCRIPTION OF THE EMBODIMENTS

First Embodiment

Figure 1:
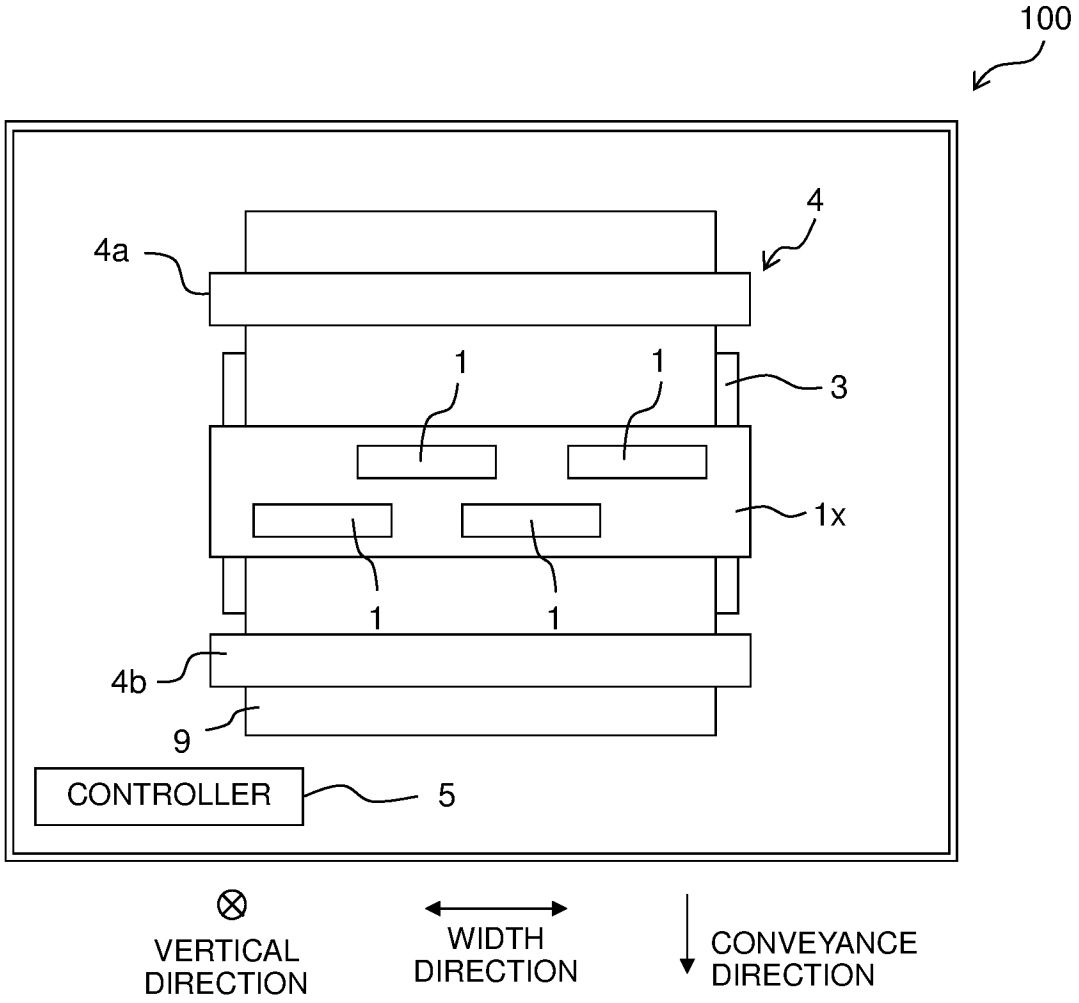
FIG. 1 is a plan view depicting a printer 100 provided with a head 1.

At first, the overall configuration of a printer 100 provided with a head 1 according to a first embodiment of the present disclosure will be explained, with reference to FIG. 1.

The printer 100 is provided with a head unit 1X including four heads 1, a platen 3, a conveyor 4, and a controller 5.

A paper sheet (sheet) 9 is placed on the upper surface of the platen 3.

Figure 5:
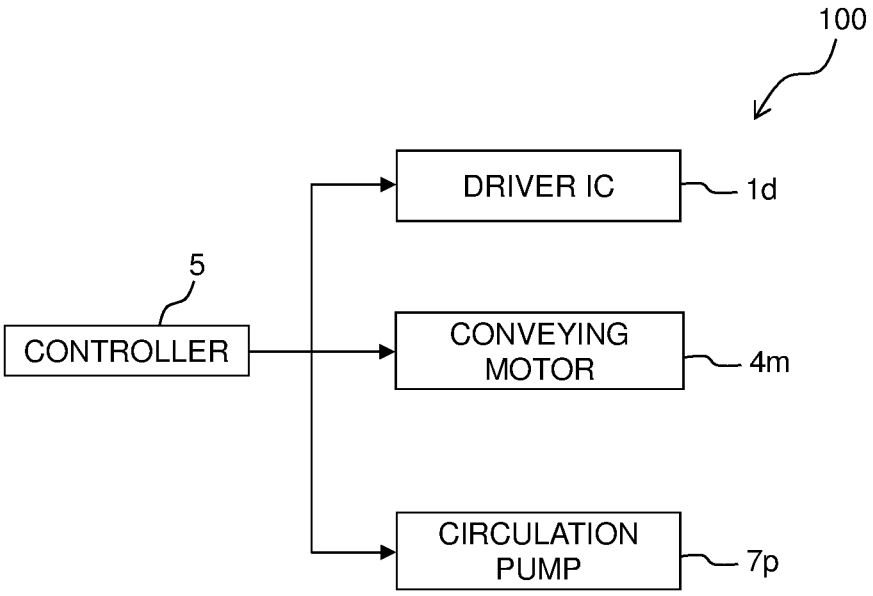
FIG. 5 is a block diagram depicting the electric configuration of the printer 100.

The conveyor 4 has a pair of two conveying rollers 4*a* and 4*b* arranged side by side in a conveyance direction, with the platen 3 being sandwiched between the pair of conveying rollers 4*a* and 4*b* in the conveyance direction. In a case that a conveying motor 4*m* (see FIG. 5) is driven by control performed by the controller 5, the pair of conveying rollers 4*a* and 4*b* are rotated in a state that the pair of conveying rollers 4*a* and 4*b* pinch or sandwich the paper sheet 9 therebetween, to thereby convey the paper sheet 9 in the conveyance direction.

The head unit 1*x* is elongated in a width direction of the paper sheet 9 (which is a direction orthogonal to both of the conveying direction and a vertical direction); the head unit 1*x* is of a line system which discharges or jets an ink from nozzles 21 (see FIGS. 2 and 3) toward the paper sheet 9 in a state that the position of the head unit 1*x* is fixed. The four heads 1 are arranged in the width direction in a staggered manner.

The controller 5 has a ROM (Read Only Memory), a RAM (Random Access Memory), and an ASIC (Application Specific Integrated Circuit). The ASIC executes a recording processing, etc., based on a program stored in the ROM. In the recording processing, the controller 5 controls a driver IC 1*d* of each of the heads 1 and the conveying motor 4*m* (see FIG. 5 for both of the driver IC 1*d* and the conveying motor 4*m*), based on a recording instruction (including image data) inputted from an external apparatus or device such as a PC, etc., to thereby record an image on the paper sheet 9.

Next, the configuration of each of the heads 1 will be explained, with reference to FIGS. 2 to 4.

Figure 3:
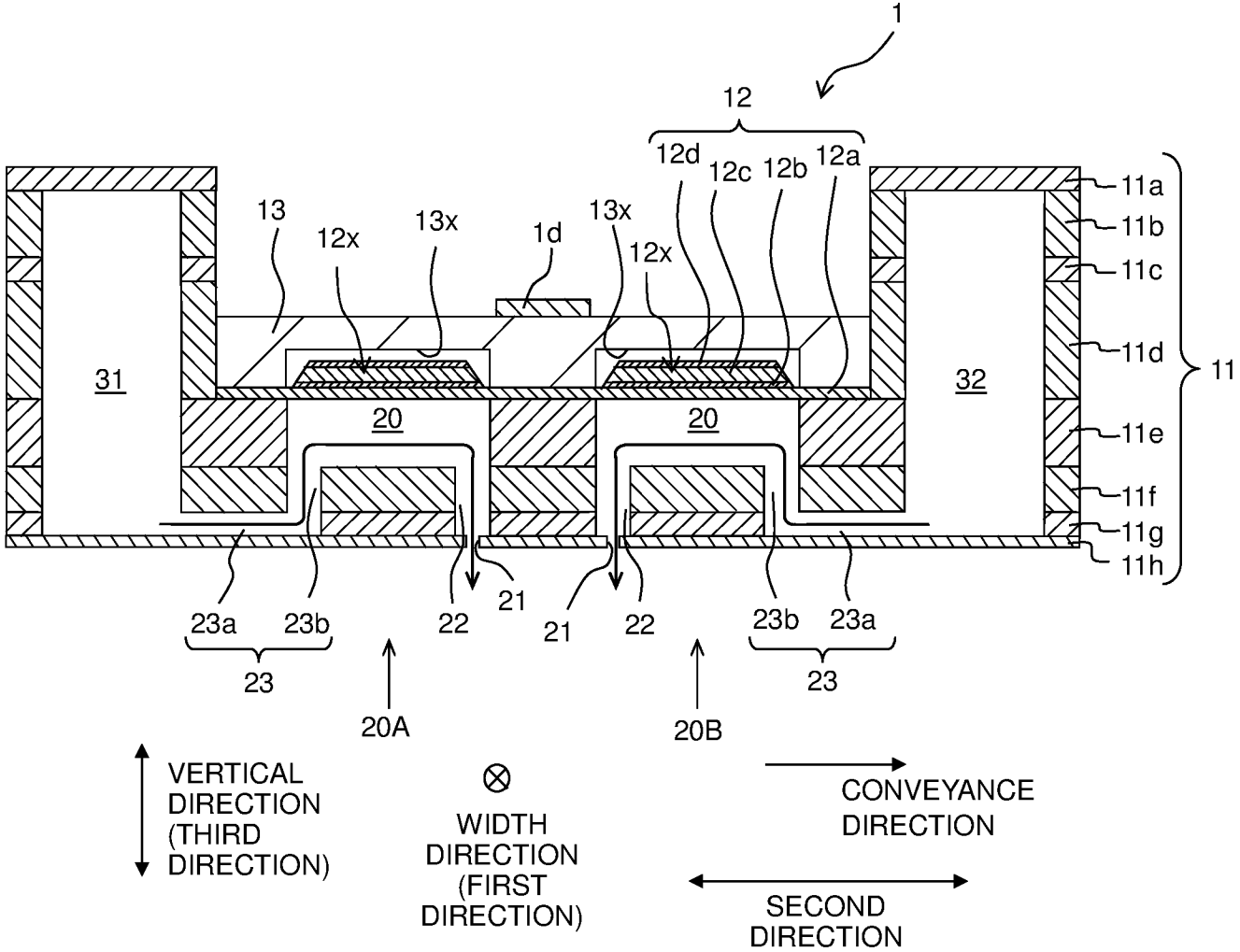
FIG. 3 is a cross-sectional view of the head 1, as taken along a line in FIG. 2.

As depicted in FIG. 3, each of the heads 1 has a channel substrate 11, an actuator substrate 12, a protective substrate 13, and a driver IC 1*d*. The driver IC 1*d* corresponds to a "driving circuit" of the present disclosure.

Figure 2:
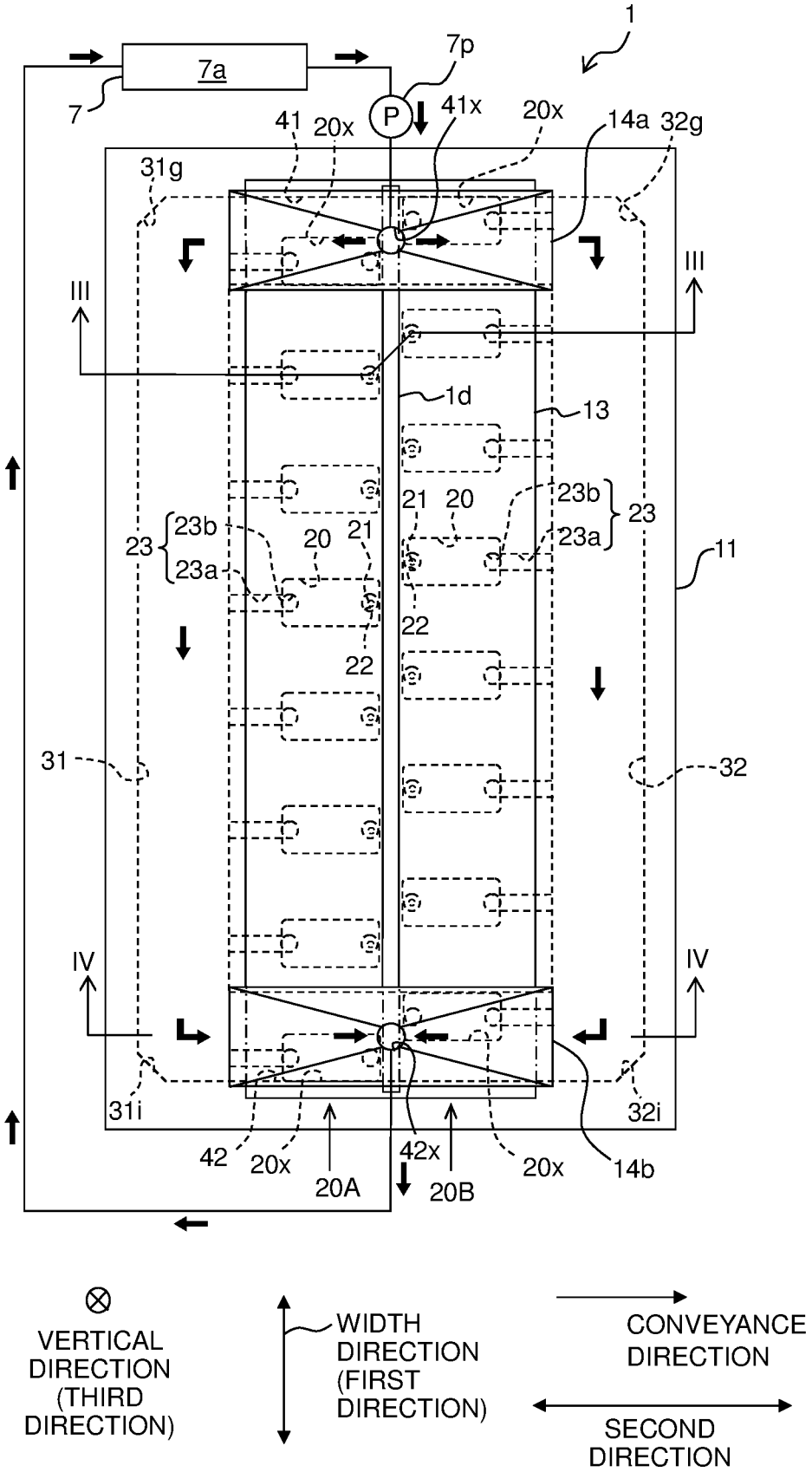
FIG. 2 is a plan view of the head 1.

The channel substrate 11 is formed with: a first common channel 31; a second common channel 32; a plurality of pressure chambers 20, 20*x*; a plurality of connecting channels 23; a plurality of connecting channels 22; and a plurality of nozzles 21, as depicted in FIG. 2.

The plurality of pressure chambers 20, 20*x* are arranged (aligned) in a staggered manner in the width direction (first direction), and construct a first pressure chamber group 20A and a second pressure chamber group 20B. The first pressure chamber group 20A and the second pressure chamber group 20B are arranged side by side in a second direction parallel to the conveyance direction, and each of the first pressure chamber group 20A and the second pressure chamber group 20B is constructed of pressure chambers 20, 20*x* which are included in the plurality of pressure chambers 20, 20*x* and which are aligned side by side in the first direction to form a row (array) at an equal spacing distance therebetween.

The plurality of pressure chambers 20, 20*x* include normal pressure chambers 20 and dummy pressure chambers 20*x*. Among the pressure chambers constructing each of the first and second pressure chamber groups 20A and 20B, pressure chambers arranged on one end and the other end, respectively, in the first direction is the dummy pressure chambers 20*x*; pressure chambers different from the dummy pressure chambers 20*x* are the normal pressure chambers 20. In other words, in each of the first and second pressure chamber groups 20A and 20B, one piece of the dummy pressure chamber 20*x* and one piece of the dummy pressure chamber 20*x* are arranged, respectively, on a side of the one end and a side on the other end in the first direction with respect to the normal pressure chambers 20. The dummy pressure chambers 20*x* have a similar configuration to that of the normal pressure chambers 20, except that each of the dummy pressure chambers 20*x* is not communicated with the nozzle 21. In the following, the normal pressure chambers 20 and the dummy pressure chamber 20*x* are referred to as "pressure chambers 20, 20*x*" in a collective manner in some cases.

Each of the first common channel 31 and the second common channel 32 extends in the first direction. The first common channel 31 is communicated with the pressure chambers 20, 20*x* belonging to the first pressure chamber group 20A, and the second common channel 32 is communicated with the pressure chambers 20, 20*x* belonging to the second pressure chamber group 20B. In the second direction, the plurality of pressure chambers 20, 20*x*, the plurality of connecting channel 23, the plurality of connecting channels 22 and the plurality of nozzles 21 are arranged between the first and second common channels 31 and 32.

Each of the plurality of pressure chambers 20, 20*x* has a substantially rectangular shape which is elongated in the second direction in a plane orthogonal to the vertical direction (a third direction orthogonal to both of the first and second directions). As depicted in FIGS. 2 and 3, each of the plurality of connecting channels 23 is connected to one end in the second direction of one of the plurality of pressure chambers 20, 20*x*, and each of the plurality of connecting channels 22 is connected to other end in the second direction of one of the plurality of pressure chambers 20, 20*x*.

The pressure chambers 20, 20*x* belonging to the first pressure chamber group 20A are each communicated with the first common channel 31 via one of the plurality of connecting channels 23. The pressure chambers 20, 20*x* belonging to the second pressure chamber group 20B are each communicated with the second common channel 32 via one of the plurality of connecting channels 23.

Each of the plurality of connecting channels 23 includes a horizontal part 23*a* connected to the first common channel 31 or the second common channel 32 and extending in a horizontal direction, and a vertical part 23*b* extending upward from a forward end of the horizontal part 23*a* and connected to one end in the second direction of one of the pressure chambers 20, 20*x*. The horizontal part 23*a* extends in the second direction.

Each of the plurality of connecting channels 22 extends downward from the other end in the second direction of one of the plurality of pressure chambers 20, 20*x*. Each of the normal pressure chambers 20 is communicated with one of the plurality of nozzles 21 via one of the plurality of connecting channels 22. Each of the plurality of nozzles 21 is located immediately below one of connecting channels 22 which are included in the plurality of connecting channels 22 and which are connected to the normal pressure chambers 20.

The first common channel 31 and the second common channel 32 are communicated with each other via a first connecting channel 41 and a second connecting channel 42.

The first connecting channel 41 connects one end (upper end in FIG. 2) in the first direction of the first common channel 31 with one end (upper end in FIG. 2) in the first direction of the second common channel 32, and extends in the second direction. The second connecting channel 42 connects the other end (lower end in FIG. 2) in the first direction of the first common channel 31 with the other end (lower end in FIG. 2) in the first direction of the second common channel 32, and extends in the second direction.

Each of the first connecting channel 41 and the second connecting channel 42 connects a side surface of the first common channel 31 and a side surface of the second common channel 32 to each other, and the first connecting channel 41 and the second connecting channel 42 are arranged between the first and second common channels 31 and 32 in the second direction.

The first connecting channel 41 overlaps, in the third direction, with a pressure chamber (dummy pressure chamber 20*x*) which are included in the plurality of pressure chambers and which is arranged at the one end (upper end in FIG. 2) in the first direction in each of the pressure chamber groups 20A and 20B. The second connecting channel 42 overlaps, in the third direction, with a pressure chamber (dummy pressure chamber 20*x*) which are included in the plurality of pressure chambers and which is arranged at the other end (lower end in FIG. 2) in the first direction in each of the pressure chamber groups 20A and 20B.

Note that in one end (upper end in FIG. 2) in the first direction in the first common channel 31, a wall on a side opposite to the pressure chambers 20, 20*x* is defined by a guide surface 31*g*. In the other end (lower end in FIG. 2) in the first direction in the first common channel 31, a wall on a side opposite to the pressure chambers 20, 20*x* is defined by a guide surface 31*i*. In one end (upper end in FIG. 2) in the first direction in the second common channel 32, a wall on a side opposite to the pressure chambers 20, 20*x* is defined by a guide surface 32*g*. In the other end (lower end in FIG. 2) in the first direction in the second common channel 32, a wall on a side opposite to the pressure chambers 20, 20*x* is defined by a guide surface 32*i*.

The guide surfaces 31*g* and 32*g* each extend in an oblique direction (direction orthogonal to the third direction and crossing both of the first and second directions), and are arranged symmetrically to each other relative to a straight line extending in the first direction while passing through the center in the second direction of the channel substrate 11. Specifically, the guide surface 31*g* is inclined such that the guide surface 31*g* approaches closer, in the second direction, from the first common channel 31 toward the second common channel 32, as the guide surface 31*g* approaches closer in a direction from the other end (lower end in FIG. 2) in the first direction toward the one end (upper end in FIG. 2) in the first direction. The guide surface 32*g* is inclined such that the guide surface 32*g* approaches closer, in the second direction, from the second common channel 32 toward the first common channel 31, as the guide surface 32*g* approaches closer in a direction from the other end (lower end in FIG. 2) in the first direction toward the one end (upper end in FIG. 2) in the first direction.

The guide surfaces 31*i* and 32*i* each extend in an oblique direction (direction orthogonal to the third direction and crossing both of the first and second directions), and are arranged symmetrically to each other relative to the straight line extending in the first direction while passing through the center in the second direction of the channel substrate 11. Specifically, the guide surface 31*i* is inclined such that the guide surface 31*i* approaches closer, in the second direction, from the first common channel 31 toward the second common channel 32, as the guide surface 31*i* approaches closer in a direction from the one end (upper end in FIG. 2) in the first direction toward the other end (lower end in FIG. 2) in the first direction. The guide surface 32*i* is inclined such that the guide surface 32*i* approaches closer, in the second direction, from the second common channel 32 toward the first common channel 31, as the guide surface 32*i* approaches closer in a direction from the one end (upper end in FIG. 2) in the first direction toward the other end (lower end in FIG. 2) in the first direction.

Each of the guide surfaces 31*g* and 31*i* does not overlap, in the second direction, with any one of the normal pressure chambers 20 belonging to the first pressure chamber group 20A; and each of the guide surfaces 32*g* and 32*i* does not overlap, in the second direction, with any one of the normal pressure chambers 20 belonging to the second pressure chamber group 20B.

A supply port 41*x* is provided on the upper surface of the first connecting channel 41.

The supply port 41 is located in a substantially central part in the second direction of the first connecting channel 41 and between the first pressure chamber group 20A and the second pressure group 20B in the second direction. Further, the supply port 41*x* is located, in the first direction, at an arrangement area in which the plurality of pressure chambers 20, 20*x* are arranged (in the present embodiment, an arrangement area of the dummy pressure chamber 20*x* arranged on the upper end in FIG. 2 in each of the pressure chamber groups 20A and 20B).

A return port 42*x* is provided on the upper surface of the second connecting channel 42.

The return port 42*x* is located in a substantially central part in the second direction of the second connecting channel 42 and between the first pressure chamber group 20A and the second pressure group 20B in the second direction. Further, the return port 42*x* is located, in the first direction, at the arrangement area in which the plurality of pressure chambers 20, 20*x* are arranged (in the present embodiment, an arrangement area of the dummy pressure chamber 20*x* arranged on the lower end in FIG. 2 in each of the pressure chamber groups 20A and 20B).

The first connecting channel 41 is communicated with a storage chamber 7*a* of a subs tank 7 via a tube attached to the supply port 41*x*. The second connecting channel 42 is communicated with the storage chamber 7*a* via a tube attached to the return port 42*x*. The storage chamber 7*a* is communicated with a main tank (not depicted in the drawings) configured to store an ink, and stores the ink supplied from the main tank.

Figure 4:
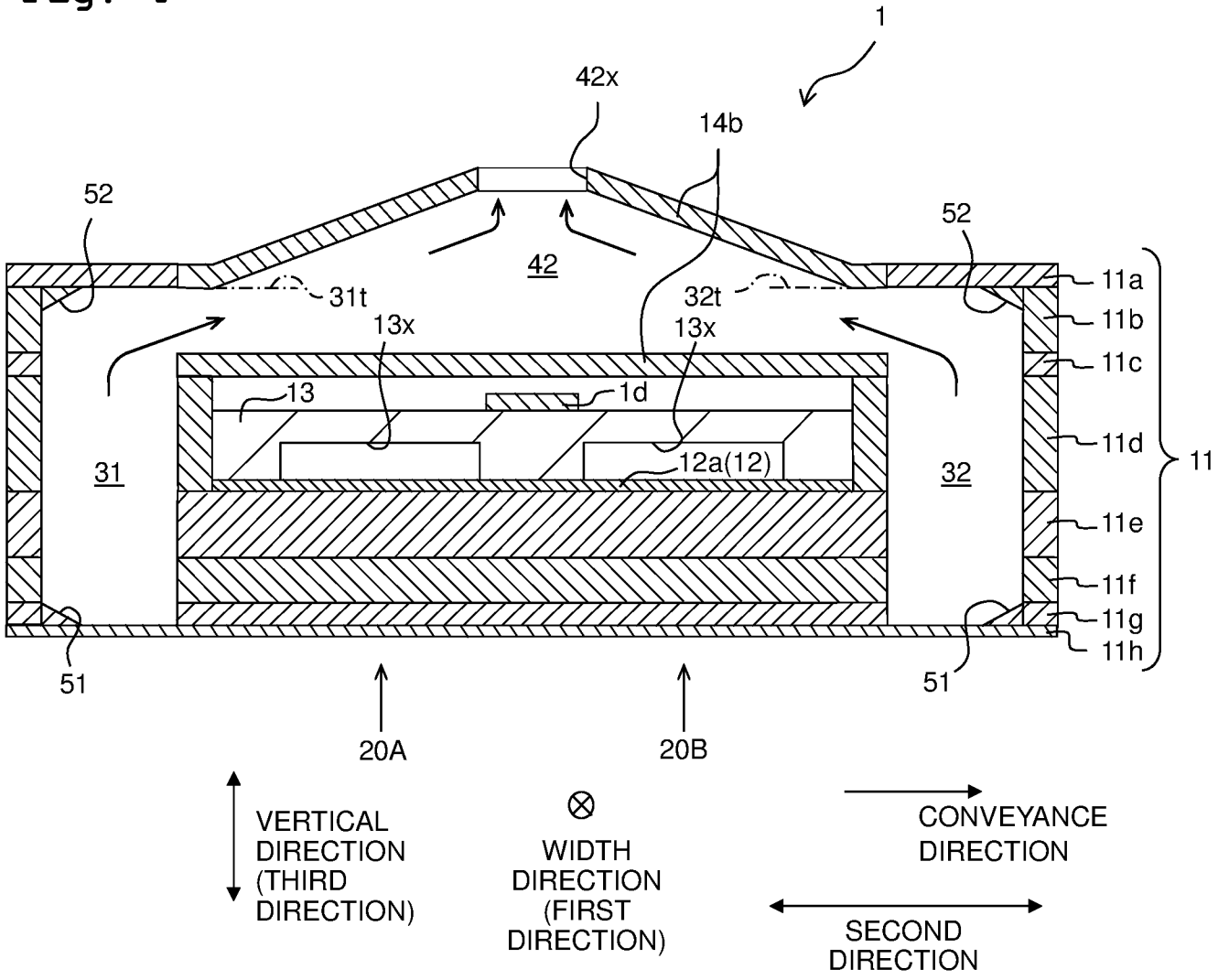
FIG. 4 is a cross-sectional view of the head 1, as taken along a IV-IV line in FIG. 2.

As depicted in FIGS. 2 and 4, the first connecting channel 41 has a shape of which width becomes narrower as approaching closer to the supply port 41*x*; and the second connecting channel 42 has a shape of which width becomes narrower as approaching closer to the return port 42*x*. Specifically, each of the first connecting channel 41 and the second connecting channel 42 has a shape which is substantially a quadrangular pyramid and in which the supply port 41*x* or the return port 42*x* is formed at an apex part thereof. Each of the first connecting channel 41 and the second connecting channel 42 has a shape in which the height of the upper surface becomes higher as approaching closer toward the center in the second direction thereof from both of the one end and the other end in the second direction, and of which width (both of the length thereof in the first direction and the length thereof in the second direction) becomes narrower as approaching closer to the upper side (in other words, each of the first and second connecting channels 41 and 42 has a shape which is widen toward the lower side thereof).

As depicted in FIG. 4, each of the first connecting channel 41 and the second connecting channel 42 is not arranged at a location above one of the first common channel 31 and the second common channel 32, and connects side surfaces of the first common channel 31 and the second common channel 32 to each other. Accordingly, a height of the upper surface at the one end in the second direction of each of the first connecting channel 41 and the second connecting channel 42 (height of the upper surface of a part, of each of the first connecting channel 41 and the second connecting channel 42, which is connected to the side surface of the common channel 31) and a height of the upper surface at the other end in the second direction of each of the first connecting channel 41 and the second connecting channel 42 (height of the upper surface of a part, of each of the first connecting channel 41 and the second connecting channel 42, which is connected to the side surface of the common channel 32) are same as a height 31*t* of the upper surface of the common channel 31 and a height 32*t* of the upper surface of the common channel 32, respectively.

Further, as depicted in FIG. 4, in each of the other end in the first direction in the first common channel 31 and the other end in the first direction in the second common channel 32, a lower wall (a wall on a side opposite to the return port 42*x*) is defined by the guide surface 51, and an upper wall (a wall on a side of the return port 42*x* in FIG. 2) is defined by the guide surface 52.

Also, in each of the one end in the first direction in the first common channel 31 and the one end in the first direction in the second common channel 32, a lower wall (a wall on a side opposite to the supply port 41*x*) is defined by the guide surface 51, and an upper wall (a wall on a side of the return port 42*x* in FIG. 2) is defined by the guide surface 52.

The guide surface 51 corresponds to a "first guide surface" of the present disclosure, and the guide surface 52 corresponds to a "second guide surface" of the present disclosure.

The guide surface 51 is inclined such that the guide surface 51 approaches closer, in the second direction, toward the pressure chamber groups 20A and 20B, as the guide surface 51 approaches closer in a direction toward the lower side (as separating farther, in the third direction, away from the supply port 41*x* and the return port 42*x*). The guide surface 52 is inclined such that the guide surface 52 approaches closer, in the second direction, toward the pressure chamber groups 20A and 20B, as the guide surface 52 approaches closer in a direction toward the upper side (as approaching closer, in the third direction, toward the supply port 41*x* and the return port 42*x*).

The guide surfaces 51 and 52 provided on the first common channel 31 are located at positions, respectively, similar to those of the guide surfaces 31*g* and 31*i* (see FIG. 2), and do not overlap, in the second direction, with any one of the normal pressure chambers 20 belonging to the first pressure chamber group 20A. The guide surfaces 51 and 52 provided on the second common channel 32 are located at positions, respectively, similar to those of the guide surfaces 32*g* and 32*i* (see FIG. 2), and do not overlap, in the second direction, with any one of the normal pressure chambers 20 belonging to the second pressure chamber group 20B.

The channel substrate 11 has eight plates 11*a* to 11*h* which are stacked on top on one another in the vertical direction, as depicted in FIGS. 3 and 4.

Among the eight plates 11*a* to 11*h*, the plate 11*a* as the uppermost layer defines the upper surfaces of the first and second common channels 31 and 32, and the plate 11*h* as the lowermost layer defines the lower surfaces of the first and second common channels 31 and 32. Further, each of the first common channel 31 and the second common channel 32 is constructed of through holes formed in the plates 11*b* to 11*g*, respectively, which are arranged between the plate 11*a* and the plate 11*h*.

As depicted in FIG. 3, each of the plurality of pressure chambers 20, 20*x* is constructed of a through hole formed in the plate 11*e*. The plate 11*e* corresponds to a "pressure chamber substrate" of the present disclosure.

The horizontal part 23*a* of each of the plurality of connecting channels 23 is constructed of a through hole formed in the plate 11*g*. The vertical part 23*b* of each of the plurality of connecting channels 23 is constructed of a through hole formed in the plate 11*f*. Each of the plurality of connecting channels 22 is constructed of through holes formed in the plates 11*f* and 11*g*, respectively. Each of the plurality of nozzles 21 is formed of a through hole formed in the plate 11*h*, and is open in the lower surface of the channel substrate 11.

The actuator substrate 12 includes, in an order from the lower side, a vibration plate 12*a*, a common electrode 12*b*, a plurality of piezoelectric bodies 12*c* and a plurality of individual electrodes 12*d*.

The vibration plate 12*a* is arranged on the upper surface of the plate 11*e*, and covers all of the plurality of pressure chambers 20, 20*x* formed in the channel substrate 11. The common electrode 12*b* and the plurality of piezoelectric bodies 12*c* are provided on each of the pressure chamber groups 20A and 20B, and are arranged so as to straddle over the pressure chambers 20, 20*x* belonging to each of the pressure chamber groups 20A and 20B. The plurality of individual electrodes 12*d* are provided on the plurality of pressure chambers 20, 20*x*, respectively, and overlap with the plurality of pressure chambers 20, 20*x*, respectively, in the vertical direction.

The common electrode 12*b* and the individual electrodes 12*d*, which are provided with respect to the normal pressure chambers 20, are electrically connected to the driver IC 1*d* via electrodes (not depicted in the drawings) passing through the inside of the protective substrate 13. The driver IC 1*d* maintains the potential of the common electrode 12*b* at the ground potential, whereas changes the potential of the individual electrodes 12*d*. Specifically, the driver IC 1*d* generates a driving signal based on a control signal from the controller 5, and applies the driving signal to a certain individual electrode 12*d* which is included in the individual electrodes 12*d*. With this, the potential of the certain individual electrode 12*d* changes between a predetermined driving potential and the ground potential. In this situation, parts (actuator 12*x*), of the vibration plate 12*a* and of the piezoelectric body 12*c*, respectively, which are sandwiched between the certain individual electrode 12*d* and a certain normal pressure chamber 20 included in the normal pressure chambers 20 and corresponding to the certain individual electrode 12*d* are deformed so as to project toward the certain normal pressure chamber 20, thereby changing the volume of the certain normal pressure chamber 20, applying pressure to the ink inside the certain normal pressure chamber 20 and thus discharging the ink from a certain nozzle 21 included in the plurality of nozzles 21 and corresponding to the certain normal pressure chamber 20. The actuator substrate 12 has a plurality of pieces of the actuator 12*x* at positions overlapping with the normal pressure chambers 20, respectively, in the vertical direction.

Note that the common electrode 12*b*, the piezoelectric body 12*c* and the individual electrodes 12*d* are arranged also as positions overlapping, in the vertical direction, with the dummy pressure chambers 20*x*, respectively. The common electrode 12*b* and the individual electrodes 12*d* provided with respect to the dummy pressure chambers 20*x*, however, are not electrically connected to the driver IC 1*d*. Accordingly, the volume of each of the dummy pressure chambers 20*x* is not changed in the above-described manner.

The protective substrate 13 is adhered to the upper surface of the vibration plate 12, and is arranged at a position at which the protective substrate 13 sandwiches the actuator substrate 12 in the vertical direction between the plate 11*e* and the protective substrate 13.

Two concave parts 13*x* are formed in the lower surface of the protective substrate 13. The two concave parts 13*x* each extend in the first direction; one of the two concave parts 13*x* overlaps, in the vertical direction, with the pressure chambers 20, 20*x* belonging to the first pressure chamber group 20A, and the other of the two concave parts 13*x* overlaps, in the vertical direction, with the pressure chambers 20, 20*x* belonging to the second pressure chamber group 20B. Actuators 12*x* which are included in the plurality of actuators 12*x* and which correspond to the pressure chamber group 20A and actuators 12*x* which are included in the plurality of actuators 12*x* and which correspond to the pressure chamber group 20B are accommodated or stored in the two concave parts, respectively.

The driver IC 1*d* is arranged on the upper surface (surface on a side opposite to anther surface facing the plurality of actuators 12*x*) of the protective substrate 13. The driver IC 1*d* is located between the two concave parts 12*x* in the second direction.

The driver IC 1*d* extends in the first direction over substantially the entire length in the first direction of the protective substrate 13. One end of a wiring circuit board (not depicted in the drawings) which is constructed, for example, of a FPC (Flexible Printed Circuit), etc., is connected to one end in the first direction of the driver IC 1*d* (for example, an upper end in FIG. 2). The other end of the wiring circuit board is connected to the controller 5. The driver IC 1*d* is electrically connected to the controller 5 via the wiring circuit board.

As depicted in FIGS. 2 and 4, the head 1 further has a channel member 14*a* having the first connecting channel 41 formed therein and a channel member 14*b* having the second connecting channel 42 formed therein.

Each of the channel members 14*a* and 14*b* is, for example, an integrally molded product formed of a resin, and is arranged at a location above the protective substrate 13, with a space present with respect to the driver IC 1*d*, as depicted in FIG. 4. In the third direction, the actuator substrate 12, the protective substrate 13 and the driver IC 1*d* are arranged between the respective channel members 14*a* and 14*b* and the plate 11*e*.

In the second direction, the channel members 14*a* and 14*b* are shorter than the channel substrate 11, and are arranged between the first common channel 31 and the second common channel 32 formed in the plate 11*a*. Upper walls on both ends in the second direction in the channel members 14*a* and 14*b* are connected to ends, of openings of the plate 11*a*, defining the upper surfaces of the common channels 31 and 32.

Lower surfaces on both ends in the second direction of the channel members 14*a* and 14*b* are adhered to the upper surface of the plate 11*d*. In a production processing of the head 1, the both ends in the second direction of the channel members 14*a* and 14*b* are pressurized downward in the third direction (namely, pressurized while avoiding a central part in the second direction (a part below which the driver IC 1*d* is arranged) of the channel members 14*a* and 14*d*) and to fix the channel members 14*a* and 14*b* to the plate 11*d*.

In a case that the ink is circulated between the sub tank 7 and the channel substrate 11 in the above-described channel configuration, the ink flows inside the channel substrate 11 in the following manner. Bold arrows in FIGS. 2 and 4 indicate flow of the ink during the circulation. Note that bold arrows in FIG. 3 indicate flow of the ink during recording; in the present embodiment, a flow of the ink from each of the common channels 31 and 32 to one of the pressure chambers 20, 20*x* is not generated during the circulation.

The circulation pump 7*p* is driven by the control performed by the controller 5, thereby causing the ink inside the storage chamber 7*a* to be supplied to the first connecting channel 41 from the supply port 41*x*. The ink inflowed into the first connecting channel 41 moves toward the one end and the other end in the second direction in the first connecting channel 41, while moving downward along the inclination of the uppers surface of the first connecting channel 41, and inflows into the one ends in the first direction in the first and second common channels 31 and 32, respectively.

The ink inflowed into the one ends in the first direction in the common channels 31 and 32, respectively, moves along the guide surfaces 31*g*, 32*g*, 51 and 52 provided on the one ends, and moves inside the first and second common channels 31 and 32 from the one ends in the first direction (upper ends in FIG. 2) toward the other ends in the first direction (lower ends in FIG. 2) of the first and second common channels 31 and 32, respectively.

The ink arrived at the other ends in the first direction (lower ends in FIG. 2) in the common channels 31 and 32, respectively, moves along the guide surfaces 31*i*, 32*i*, 51 and 52 provided on the other ends, and inflows into the one end and the other end in the second direction in the second connecting channel 42. The ink inflowed into the second connecting channel 42 moves toward the central part in the second direction in the second connecting channel 42, while moving upward along the inclination of the upper surface of the second connecting channel 42, flows out from the return port 42*x* and is returned to the storage chamber 7*a*.

By allowing the ink to circulate between the sub tank 7 and the channel substrate 11 in such a manner, it is possible to realize the removal of any air bubble(s) in the channel(s) formed in the channel substrate 11 and/or to prevent any increase in the viscosity of the ink in the channel(s) formed in the channel substrate 11. Further, in a case that the ink contains a sediment component (a component which might sediment or settle; a pigment, etc.), such a sediment component is agitated, which in turn prevents any sedimentation thereof from occurring.

As described above, the head 1 of the present embodiment is provided with: the two (first and second) pressure chamber groups 20A and 20B each of which is constructed of the pressure chambers 20, 20*x* aligned in the first direction; the two (first and second) common channels 31 and 32 provided with respect to the two pressure chamber groups 20A and 20B, respectively; the first connecting channel 41 connecting the one end in the first direction of the first common channel 31 and the one end in the first direction of the second common channel 32 to each other; and the second connecting channel 42 connecting the other end in the first direction of the first common channel 31 and the other end in the first direction of the second common channel 32 to each other. Each of the first connecting channel 41 and the second connecting channel 42 overlaps, in the third direction (direction orthogonal to both of the first direction, and the second direction in which the two pressure chamber groups 20A and 20B are arranged side by side), with the pressure chamber (with the dummy pressure chamber in the present embodiment) among the plurality of pressure chambers (see FIG. 2). By arranging the first and second connecting channels 41 and 42 in such a manner, it is possible to realize the circulation of the ink along the connecting channels 41 and 42 and along the common channels 31 and 32, while suppressing the increase in the size in the first direction of the head 1.

The first connecting channel 41 overlaps, in the third direction, with the pressure chamber (dummy pressure chamber 20*x*) which is included in the pressure chambers 20, 20*x* and which is arranged at the one end in the first direction (the upper end in FIG. 2) in each of the first and second pressure chamber groups 20A and 20B. The second connecting channel 42 overlaps, in the third direction, with the pressure chamber (dummy pressure chamber 20*x*) which is included in the pressure chambers 20, 20*x* and which is arranged at the other end in the first direction (the lower end in FIG. 2) in each of the first and second pressure chamber groups 20A and 20B. In this case, the ink can be circulated along the entire lengths in the first direction of the common channels 31 and 32.

Among the plurality of pressure chambers 20, 20*x*, the pressure chambers arranged in the one end (the upper end in FIG. 2) and the other end (the lower end in FIG. 2) are the dummy pressure chambers 20*x*. In this case, it is possible to obtain the effects such as the suppression of crosstalk and the increase in forming or molding precision, etc., owing to the provision of the dummy pressure chambers 20$x$. Note that since the drawing is simplified in the illustration of FIG. 2, the first connecting channel 41 appears to overlap, in the third direction, with one dummy pressure chamber 20$x$ in each of the first and second pressure chamber groups 20A and 20B. In the present embodiment, however, the length in the width direction (first direction) of each of the pressure chambers 20, 20$x$ is approximately 60 μm, and the first connecting channel 41 overlap, in the third direction, with 30 (thirty) to 40 (forty) pieces of the dummy pressure chamber 20$x$ in each of the first and second pressure chamber groups 20A and 20B. Note that in the present embodiment, although the dummy pressure chambers 20$x$ have a same size (dimension) as that of the normal pressure chambers 20, it is not necessarily indispensable that the dummy pressure chambers 20$x$ have the same size (dimension) as that of the normal pressure chambers 20. For example, it is allowable that dummy pressure chambers 20$x$ which overlap with the first connecting channel 41 in the third direction are formed as one dummy pressure chamber 20$x$. Namely, it is allowable to form one dummy pressure chamber 20$x$ of which size is approximately same as sizes of thirty to forty pieces of the dummy pressure chamber 20$x$.

Each of the first connecting channel 41 and the second connecting channel 42 extends in the second direction (see FIG. 2). In this case, by allowing the direction (second direction) in which each of the first connecting channel 41 and the second connecting channel 42 extends and the direction (first direction) in which each of the first common channel 31 and the second common channel 32 extends to cross each other (in the present embodiment, to be orthogonal to each other), any turbulent flow easily occurs at connection parts or locations at which the first and second connecting channels 41 and 42 are connected to the first and second common channels 31 and 32. In a case that the ink contains a sediment component, such a sediment component is agitated by the turbulent flow, which in turn is effective in preventing any sedimentation of the sediment component.

The supply port 41$x$ and the return port 42$x$ are located, in the second direction, between the first pressure chamber group 20A and the second pressure chamber group 20B (see FIG. 2). In this case, it is possible to suppress any unevenness in an amount of the ink (ink amount) to be supplied to the two pressure chamber groups 20A and 20B.

The first connecting channel 41 has the shape of which width becomes narrower as approaching closer toward the supply port 41$x$; and the second connecting channel 42 has the shape of which width becomes narrower as approaching closer toward the return port 42$x$ (see FIGS. 2 and 4). Since the vicinity of the supply port 41$x$ and the vicinity of the return port 42$x$ are parts or locations at which the direction of the flow of the ink is changed, the flow rate of the ink might become slower and any stagnation might easily occur. In view of this, the present embodiment allows the first connecting channel 41 and the second connecting channel 42 to have the above-described shapes, respectively, thereby increasing the flow rate of the ink in the vicinity of each of the supply port 41$x$ and the return port 42$x$ and thus making it possible to suppress any stagnation from occurring. Further, since each of the first connecting channel 41 and the second connecting channel 42 has the shape which is widen toward the lower side thereof, the ink flows smoothly from the first connecting channel 41 to each of the first and second common channels 31 and 32, and ink flows smoothly from each of the first and second common channels 31 and 32 to the second connecting channel 42.

The return port 42$x$ is provided on the upper surface in the second connecting channel 42; and the second connecting channel 42 has the shape of which width becomes narrower as approaching closer toward the upper side (see FIG. 4). In this case, any air bubble(s) in the ink flows smoothly toward the return port 42$x$ due to the buoyance and the above-described shape of the second connecting channel 42, and is discharged (exhausted).

The supply port 41$x$ and the return port 42$x$ are provided on the surfaces (the upper surfaces in the present embodiment) in the first connecting channel 41 and the second connecting channel 42, respectively, each of the surfaces being orthogonal to the third direction (see FIGS. 2 and 4). Provided that supply port 41$x$ and the return port 42$x$ are provided on side surfaces (surfaces along the third direction) of the first connecting channel 41 and the second connecting channel 42, respectively, then tubes attached to the supply port 41$x$ and the return port 42$x$, respectively, extend in the first direction, which in turn might enlarge the size in the first direction of the head 1. In view of this, the present embodiment has such a configuration wherein the supply port 41$x$ and the return port 42$x$ are provided on the surfaces in the first connecting channel 41 and the second connecting channel 42, respectively, each of the surfaces being orthogonal to the third direction. Therefore, it is possible to easily arrange the tubes attached to the supply port 41$x$ and the return port 42$x$, respectively, such that the tubes extend in the third direction, thereby making it possible to suppress any increase in the size in the first direction of the head 1.

Each of the supply port 41$x$ and the return port 42$x$ is provided, in the first direction, on the arrangement area in which the plurality of pressure chambers 20, 20$x$ are arranged (see FIG. 2). Specifically, the supply port 41$x$ is provided on an arrangement area of the dummy pressure chamber 20$x$ which is arranged at one end (the upper end in FIG. 2) in each of the first and second pressure chamber groups 20A and 20B; and the return port 42$x$ is provided on an arrangement area of the dummy pressure chamber 20$x$ which is arranged at the other end (the lower end in FIG. 2) in each of the first and second pressure chamber groups 20A and 20B. In this case, it is possible to suppress the increase in size in the first direction of the head 1 in a more ensured manner, as compared with such a case that each of the supply port 41$x$ and the return port 42$x$ is provided, in the first direction, outside the arrangement area in which the plurality of pressure chambers 20, 20$x$ are arranged.

In each of the one end and the other end in the first direction in the first common channel 31 and the one end and the other end in the first direction of the second common channel 32, the lower wall (the wall which is on a side opposite to the return port 42$x$) is defined by the guide surface 51, and the upper wall (the wall on the side of the return port 42$x$) is defined by the guide surface 52 (see FIG. 4). The one end and the other end in the first direction in the first common channel 31 and the one end and the other end in the first direction in the second common channel 32 are connection parts or locations with respect to the connecting channels 41 and 42, respectively, at which the direction of the flow of the ink is changed. Accordingly, the flow rate of the ink might become slow and any stagnation might easily occur. In view of this, the present embodiment provides the guide surfaces 51 and 52 in these parts or locations, respectively, thereby allowing the ink to flow smoothly along the guide surfaces 51 and 52 and thus making it possible to suppress any stagnation from occurring.

The guide surfaces 51 and 52 provided on the first common channel 31 do not overlap, in the second direction, with any of the normal pressure chambers 20 belonging to the first pressure chamber group 20A; and the guide surfaces 51 and 52 provided on the second common channel 32 do not overlap, in the second direction, with any of the normal pressure chambers 20 belonging to the second pressure chamber group 20B. In such a case that the guide surfaces 51 and 52 overlap, in the second direction, with a certain normal pressure chamber 20 among the normal pressure chambers 20, the flow rate of the ink is increased in the certain normal pressure chamber 20, and any unevenness (fluctuation or variation) in the ink discharge performance might occur in a certain nozzle 21 included in the nozzles 21 and communicating with the certain normal pressure chamber 20, and other nozzles 21 included in the nozzles 21 and communicating with other normal pressure chambers 20 different from the certain normal pressure chamber 20. Further, in such a case, the channel resistance might be increased in the certain normal pressure chamber 20, which in turn might cause the under-refill phenomenon. In view of this, the present embodiment has a such a configuration wherein the guide surfaces 51 and 52 do not overlap, in the second direction, with any of the normal pressure chambers 20, thus making it possible to suppress the above-described problem.

The heights 31*t* and 32*t* of the upper surfaces of the first and second common channels 31 and 32, respectively, and heights of the upper surfaces of the one end and the other end in the second direction of the first and second connecting channels 41 and 42, respectively, are same to one another (see FIG. 4). In this case, the height of the upper surface of the channel from the outlet port of the first connecting channel 41 up to the inlet port of the second connecting channel 42 via the first and second common channels 31 and 32 are constant, thereby making it possible to lower the pressure loss and to increase the ink circulation amount, as compared with such a case that the height of the upper surface of this channel is changed.

The driver IC 1*d* extends in the first direction in the upper surface in the protective substrate 13 (the surface on a side opposite to the another surface, in the protective substrate 13, facing the plurality of actuators 12*x*) (see FIGS. 2 to 4). There is conceived such a case, unlike the present embodiment, that an end of a wiring circuit board which is constructed, for example, of a COF (Chip On Film) having the driver IC 1*d* mounted thereon, etc., is fixed to the upper surface of the actuator substrate 12 and the wiring circuit board is drawn upward such that the wiring circuit board straddles over the plurality of pressure chambers 20, 20*x* in the first direction. In such a configuration, in a case that the wiring circuit board is present at a location above the pressure chambers (dummy pressure chambers 20*x*) arranged at the one end and the other end in the first direction, it is difficult to arrange the first and second connecting channels 41 and 42. In view of this, the present embodiment has such a configuration wherein the driver IC 1*d* extends in the first direction in the upper surface in the protective substrate 13, owing to which the spaces above the pressure chambers (dummy pressure chambers 20*x*) arranged at the one end and the other end in the first direction, respectively, are not occupied by the wiring circuit board, thereby making it possible to easily arrange the first and second connecting channels 41 and 42.

The channel members 14*a* and 14*b* formed with the first and second connecting channels 41 and 42, respectively, are arranged at positions, respectively, at which the channel members 14*a* and 14*b* sandwich, in the third direction, the actuator substrate 12, the protective substrate 13 and the driver IC 1*d* between the plate 11*e* and the channel members 14*a* and 14*b*. By arranging the channel members 14*a* and 14*b* in such a manner, it is possible to suppress the increase in size in the first direction of the head 1, while adopting the configuration wherein the driver IC 1*d* is arranged on the upper surface of the protective substrate 13.

Second Embodiment

Next, a head 201 according to a second embodiment of the present disclosure will be explained, with reference to FIGS. 6 and 7.

In the first embodiment, the first and second connecting channels 41 and 42 are arranged, respectively, in the vicinities of the both ends in the first direction of the head 1; and the first and second connecting channels 41 and 42 overlap, in the third direction, with the pressure chambers (dummy pressure chambers 20*x*) which are arranged at the both ends in the first direction of the first and second pressure chamber groups 20A and 20B, respectively (see FIG. 2). In contrast, the second embodiment has such a configuration wherein the first and second connecting channels 241 and 242 are arranged at locations, respectively, which are closer to a central part in the first direction of the head 201 than in the first embodiment; and the first and second connecting channels 241 and 242 do not overlap, in the third direction, with certain pressure chambers (dummy pressure chambers 20*x*) which are included in the plurality of pressure chambers and which are arranged at the both ends in the first direction in the first and second pressure chamber groups 20A and 20B, respectively; and the first and second connecting channels 241 and 242 overlap, in the third direction, with pressure chambers (normal pressure chambers 20) which are arranged closer to the central part in the first direction in the head 201, relative to the certain pressure chambers (see FIG. 6), in the first and second pressure chamber groups 20A and 20B, respectively.

Further, in the first embodiment, the heights 31*t* and 32*t* of the upper surfaces of the first and second common channels 31 and 32, respectively, and the heights of the upper surfaces of the one end and the other end in the second direction of the first and second connecting channels 41 and 42, respectively, are same to one another (see FIG. 4). In the second embodiment, however, the heights of the upper surfaces of the first and second connecting channels 241 and 242, respectively, are higher than heights 231*t* and 232*t* of the upper surfaces of the first and second common channels 231 and 232 (see FIG. 7).

In the following, only a part or portion, a configuration, etc., in the second embodiment which are different from those of the first embodiment will be explained, whereas an explanation for a part, element or component of which configuration is similar to that in the first embodiment will be appropriately omitted.

The first connecting channel 241 does not overlap, in the third direction, with a certain pressure chamber (dummy pressure chamber 20*x*) arranged at the one end in the first direction in each of the first and second pressure groups 20A and 20B, and overlaps, in the third direction, with a pressure chamber (normal pressure chamber 20) which is arranged closer to a side of the other end in the first direction relative to the certain pressure chamber (dummy pressure chamber 20*x*). The second connecting channel 242 does not overlap, in the third direction, with a certain pressure chamber (dummy pressure chamber 20*x*) arranged at the other end in the first direction in each of the first and second pressure groups 20A and 20B, and overlaps, in the third direction, with a pressure chamber (normal pressure chamber 20) which is arranged closer to a side of the one end in the first direction relative to the certain pressure chamber (dummy pressure chamber 20*x*).

Figure 7:
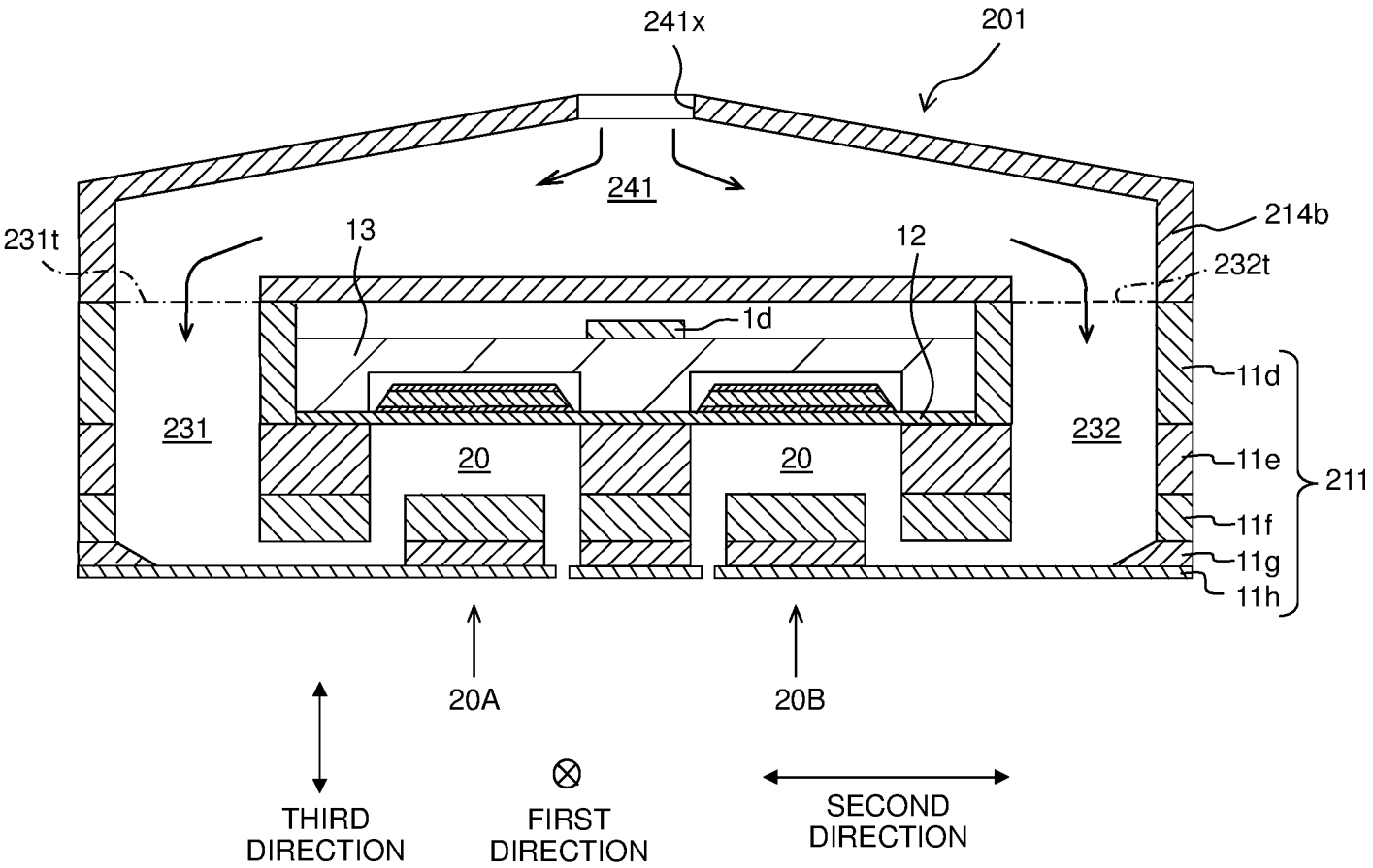
FIG. 7 is a cross-sectional view of the head 201, as taken along a VII-VII line in FIG. 6.

Each of the first connecting channel 241 and the second connecting channel 242 connects the upper surfaces of the first common channel 231 and the second common channel 232 to each other; the first connecting channel 241 and the second connecting channel 242 are arranged respectively at locations which are over the first and second common channels 231 and 232 so as to straddle, in the second direction, over the first and second common channels 231 and 231 (see FIG. 7).

Similarly to the first embodiment, the first connecting channel 241 has a shape of which width becomes narrower as approaching closer toward the supply port 241*x*; and the second connecting channel 242 has a shape of which width becomes narrower as approaching closer toward the return port 242*x*. Specifically, each of the first connecting channel 241 and the second connecting channel 242 has a shape which is substantially a quadrangular pyramid and in which the supply port 241*x* or the return port 242*x* is formed at an apex part thereof. Each of the first connecting channel 241 and the second connecting channel 242 has a shape in which the height of the upper surface becomes higher as approaching closer toward the center in the second direction thereof from both of the one end and the other end in the second direction, and of which width (both of the length thereof in the first direction and the length thereof in the second direction) becomes narrower as approaching closer toward the upper side.

The shapes and sizes of the first connecting channel 241 and the second connecting channel 242, respectively, are same to one another; and the height of the upper surface of each of the first and second connecting channels 241 and 242 is the lowest at the one end and the other end thereof in the second direction (parts or locations at which the first and second connecting channels 241 and 242 connect to the upper surfaces of the first and second common channels 231 and 232, respectively), and is the highest in the central part thereof in the second direction. In the second embodiment, each of the first and second connecting channels 241 and 242 is arranged at a location over the first and second common channels 231 and 232, and connects the upper surfaces of the first and second common channels 231 and 232 to each other. Accordingly, a height of the upper surface at the one end in the second direction of the first connecting channel 241 and a height of the upper surface at the other end in the second direction of the second connecting channel 242 are higher than a height 231*t* of the upper surface of the common channel 231 and a height 232*t* of the upper surface of the common channel 232.

The channel substrate 211 has five plates 11*d* to 11*h* which are stacked on top on one another in the vertical direction; and one plate (not depicted in the drawings) which is arranged on the upper surface of the plate 11*d* and defines the upper surfaces of the first and second common channels 231 and 232. Each of the first and second common channels 231 and 232 is formed of through holes formed in the plates 11*d* to 11*g*, respectively.

Each of the channel members 214*a* and 214*b* is, for example, an integrally molded product formed of a resin, and is arranged at a location above the protective substrate 13, with a space present with respect to the driver IC 1*d*, in a similar manner as in the first embodiment. In the third direction, the actuator substrate 12, the protective substrate 13 and the driver IC 1*d* are arranged between the respective channel members 214*a* and 214*b* and the plate 11*e*.

Figure 6:
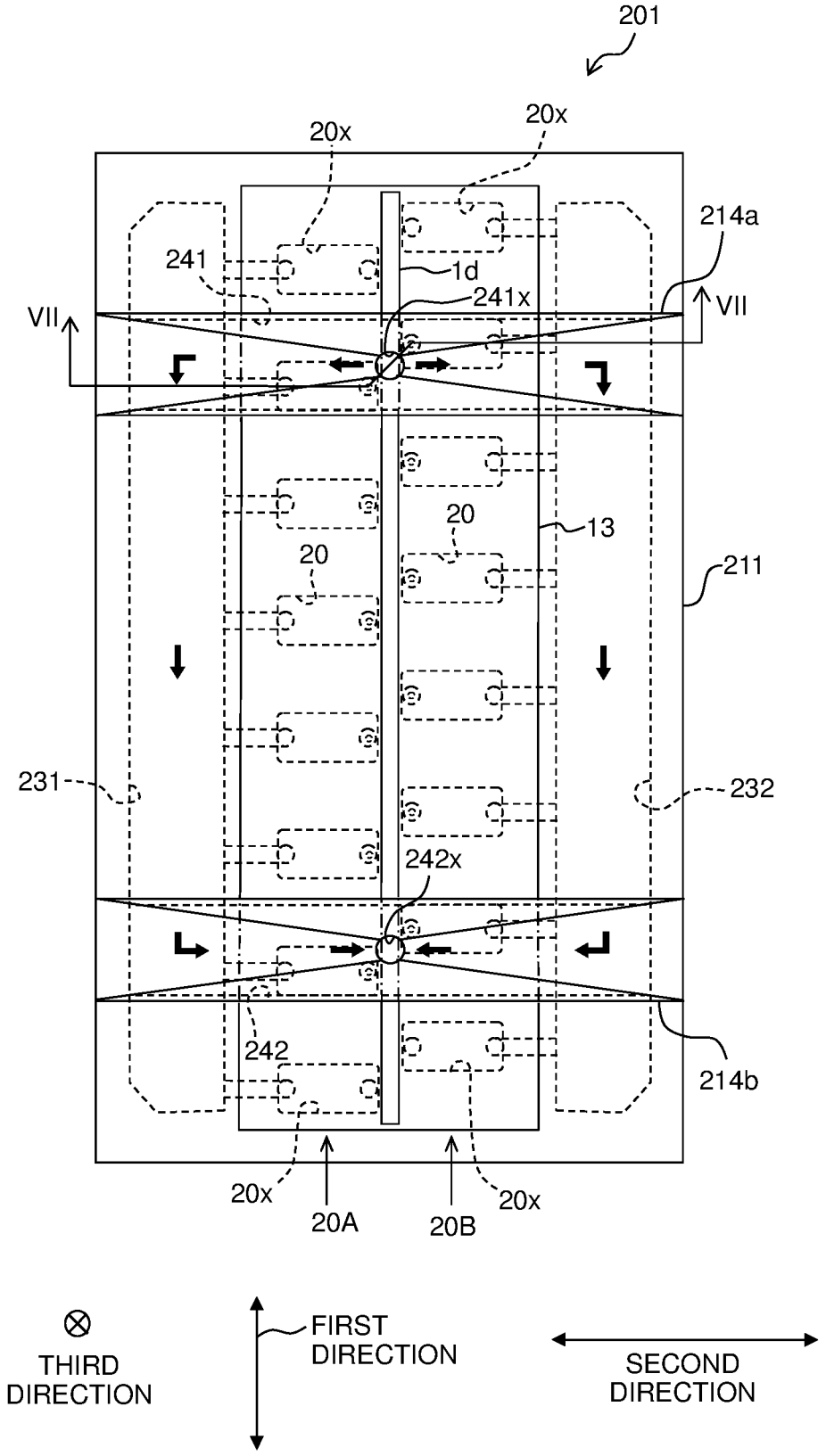
FIG. 6 is a plan view depicting a head 201.

The channel members 214*a* and 214*b* are longer in the second direction than the channel members 14*a* and 14*b* in the first embodiment (see FIGS. 2 and 4), and have a length in the second direction which is same as that of the channel substrate 211 (see FIGS. 6 and 7). The channel members 214*a* and 214*b* are arranged at a location above the channel substrate 211.

The lower surfaces of both ends in the second direction in the channel members 214*a* and 214*b* are adhered to the upper surface of the plate 11*d*. In a production processing of the head 201, similarly to that in the first embodiment, the both ends in the second direction of the channel members 214*a* and 214*b* are pressurized downward in the third direction (namely, pressurized while avoiding a central part in the second direction (a part below which the driver IC 1*d* is arranged) of the channel members 214*a* and 214*b*) and to fix the channel members 214*a* and 214*b* to the plate 11*d*.

In a case that the ink is circulated between the sub tank 7 (see FIG. 2) and the channel substrate 211 in the above-described channel configuration, the ink flows inside the channel substrate 211 in the following manner Bold arrows in FIGS. 6 and 7 indicate flow of the ink during the circulation.

The ink inflowed from the supply port 241*x* into the first connecting channel 241 moves toward the one end and the other end in the second direction in the first connecting channel 241, while moving downward along the inclination of the upper surface of the first connecting channel 241, and inflows to locations in the vicinity of the one ends in the first direction in the first and second common channels 231 and 232, respectively. This ink moves from the locations in the vicinity of the one ends in the first direction toward locations in the vicinity of the other ends in the first direction in the first and second common channels 231 and 232, respectively, and inflows into the one end and other end in the second direction in the second connecting channel 242. The ink inflowed into the second connecting channel 242 moves toward the central part in the second direction in the second connecting channel 242, while moving upward along the inclination of the upper surface of the second connecting channel 242, flows out from the return port 242*x* and is returned to the storage chamber 7*a* (see FIG. 2).

As described above, according to the second embodiment, the following effect can be obtained, in addition to the effect based on the configuration similar to that of the first embodiment.

The first and second connecting channels 241 and 242 do not overlap, in the third direction, with the certain pressure chambers (dummy pressure chambers 20*x*) which are arranged at the both ends in the first direction in the first and second pressure chamber groups 20A and 20B, respectively; and the first and second connecting channels 241 and 242 overlap, in the third direction, with the pressure chambers (normal pressure chambers 20) which are arranged closer to the central part in the first direction in the head 201, relative to the certain pressure chambers, in the first and second pressure chamber groups 20A and 20B, respectively (see FIG. 6). In the configuration of the first embodiment (wherein the first and second connecting channels 41 and 42 overlap, in the third direction, with the pressure chambers arranged on the both ends in the first direction, respectively), an attaching member (a fixing member including, for example, a tube, a screw configured to fix the tube to the supply port 41*x* or the return port 42*x*, etc.) which is to be attached to each of the supply port 41*x* and the return port

42*x* easily projects toward the outside of the head 1 in the first direction, which in turn might increase the size in the first direction of the head 1 as a whole, including the attaching member. Further, in this case, in the configuration wherein the four heads 1 are arranged in the staggered manner in the first direction as depicted in FIG. 1, and if any attempt is made so as to secure a spacing distance for the attaching member between adjacent heads 1 which are included in the four head 1 and which are adjacent to each other in the first direction, the size in the first direction of the head unit 1*x* including the four heads 1 might be increased. In view of this, according to the second embodiment, the first and second connecting channels 241 and 242 are arranged at the locations, respectively, which are closer to the central part in the first direction of the head 201, and thus the attaching members hardly project toward the outside of the head 201 in the first direction, which in turn makes it possible to suppress the increase in the size in the first direction of the head 201 as a whole, including the attaching members. Furthermore, it is also possible to suppress the increase in the size in the first direction of the head unit 1*x* including the four heads 201 in a case that the four head units 201 are arranged side by side in the first direction in the staggered manner, as depicted in FIG. 1.

Note that in a case that the first and second connecting channels 241 and 242 are arranged at the locations, respectively, which are closer to the central part in the first direction of the head 201, the ink is hard to flow into certain pressure chambers which are arranged at the both ends in the first direction in each of the first and second pressure chamber groups 20A and 20B (pressure chambers which are located on the outer side in the first direction relative to the first and second connecting channels 241 and 242); however, the certain pressure chambers are the dummy pressure chambers 20*x*. Accordingly, it is possible to suppress a problem (any discharge failure, etc.) due to the situation that the ink is hard to flow into the certain pressure chambers.

The heights of the upper surfaces of the first and second connecting channels 241 and 242, respectively, are higher than the heights of the upper surfaces of the first and second common channels 231 and 232 (see FIG. 7). In this case, it is possible to produce the head 201 by attaching the channel members 214*a* and 214*b* constructing the first and second connecting channels 241 and 242, respectively, to the upper surface of the channel substrate 211 provided with the first and second common channels 231 and 232 of which depths (lengths in the third direction) are suppressed. In other words, there is no need to make the depths of the first and second common channels 231 and 232 to be excessively great, and the degree of freedom of design is increased, such as being capable of utilizing an existing channel substrate, etc.

<Modifications>

Although the embodiments of the present disclosure have been explained in the foregoing, the present disclosure is not limited to or restricted by the above-described embodiments; it is allowable to make a various kind of design changes to the present disclosure, within the scope described in the claims.

It is allowable that the second direction crosses the first direction, and the second direction is not limited to being orthogonal to the first direction.

It is allowable to omit the guide surface(s).

The driving circuit and/or the wiring circuit board is/are not limited to being arranged as in the above-described embodiments. Note that, however, it is preferred to devise an aspect for arranging the driving circuit and/or the wiring circuit board so that the space for arranging the first and second connecting channels are secured.

The protective substrate may be omitted.

In the above-described embodiments, each of the first pressure chamber group and the second pressure chamber group is constructed of the pressure chambers aligned in a row (array). It is allowable, however, that each of the first pressure chamber group and the second pressure chamber group is constructed of pressure chambers aligned in (so as to form) a plurality of rows.

In the embodiments, one piece of the dummy pressure chamber is provided on each of the one end and the other end in the first direction of one of the pressure chamber groups. The present disclosure, however, is not limited to this configuration. It is allowable, for example, that two or more pieces of the dummy pressure chamber are provided on each of the one end and the other end in the first direction of one of the pressure chamber groups.

It is allowable that the dummy pressure chamber is communicated with the nozzle. Further, it is allowable that any electrode and/or piezoelectric body are/is not provided on the dummy pressure chamber.

It is allowable that each of the pressure chamber groups is constructed of a plurality of normal pressure chambers, and does not include any dummy pressure chamber.

It is allowable that each of the first and second connecting channels overlaps, in the third direction, with the normal pressure chambers, rather than with the dummy pressure chambers.

The above-described embodiments are each provided with the two channel members that are the channel member formed with the first connecting channel and the channel member formed with the second connecting channel. The present disclosure, however, is not limited to this configuration. It is allowable, for example, to provide one channel member formed with both of the first and second connecting channels.

In the above-described embodiments, each of the first and second connecting channels has a width covering one pressure chamber belonging to one of the pressure chamber groups. The present disclosure, however, is not limited to this configuration. For example, in such a case that each of the pressure chamber groups is constructed of 400 pieces of the pressure chamber, each of the first and second connecting channels may have a width covering approximately 20 pieces of the pressure chamber.

Each of first and second connecting channels may connects three or more pieces of the common channel. For example, it is allowable that a third common channel is further provided on the right side of the second common channel 32 in FIG. 2, and that each of the first and second connecting channels 41 and 42 extends in the second direction so as to connect the first to third connecting channels which are arranged side by side in the second direction.

The first common channel and the second common channel may be connected to each other by three or more pieces of the connecting channel. For example, a third connecting channel may be provided, in the first direction, between the first connecting channel 41 and the second connecting channel 42 in FIG. 2. In this case, one of the supply port and the return port may be provided on each of the first connecting channel 41 and the second connecting channel 42, and the other of the supply port and the return port may be provided the third connecting channel.

Each of the first and second connecting channels may have a cross section of which size and shape is constant along the longitudinal direction of the channel. For example, each of the first and second connecting channels may have an upper surface which is flat and of which height is constant along the longitudinal direction of the channel.

The supply port and the return port may be provided on the lower surfaces of the first and second connecting channels, respectively, rather than on the upper surfaces of the first and second connecting channels, respectively. Alternatively, the supply port and the return port may be provided on side surfaces of the first and second connecting channels, respectively.

Although the number of the nozzle communicating with one pressure chamber is 1 (one) piece in the above-described embodiments, the number may be not less than 2 (two). Also, in the above-described embodiments, although one pressure chamber is provided with respect to one nozzle, it is allowable that two or more pressure chambers are provided with respect to one nozzle.

The actuator is not limited to being an actuator of the piezoelectric system using the piezoelectric element, and may be of another system (for example, of the thermal system using a heating device or element, of the electrostatic system using the electrostatic force, etc.).

The head is not limited to being the head of the line system, and may be a head of the serial system (such a system that the head is configured to discharge a liquid from the nozzle toward a target or object of discharge, while moving in a scanning direction parallel to the width direction).

The object of the discharge is not limited to the paper (paper sheet) and may be, for example, cloth, a substrate, etc.

The liquid discharged from the nozzles is not limited to the ink, and may be any liquid (for example, a treatment liquid which causes a component in an ink to aggregate or deposit, etc.).

The present disclosure is not limited to being applicable to the printer, and is applicable also to a facsimile machine, a copying machine, a multi-function peripheral, etc. Further, the present disclosure is also applicable to a liquid discharge apparatus which is suitable for a usage which is different from performing recording of an image (for example, a liquid discharge apparatus which discharges a conductive liquid onto a substrate so as to form a conductive pattern on the substrate, etc.).

What is claimed is:

1. A liquid discharge head comprising:

a plurality of pressure chambers forming a first pressure chamber group and a second pressure chamber group, the first pressure chamber group including a part of the pressure chambers aligned in a first direction, and the second pressure chamber group including another part of the pressure chambers aligned in the first direction, and the second pressure chamber group being arranged side by side relative to the first pressure chamber group in a second direction crossing the first direction;

a first common channel extending in the first direction and communicating with the part of the pressure chambers belonging to the first pressure chamber group;

a second common channel extending in the first direction, communicating with the other part of the pressure chambers belonging to the second pressure chamber group, and arranged side by side relative to the first common channel in the second direction;

a first connecting channel connecting one end in the first direction of the first common channel and one end in the first direction of the second common channel; and a second connecting channel connecting the other end in the first direction of the first common channel and the other end in the first direction of the second common channel, wherein each of the first connecting channel and the second connecting channel overlaps, in a third direction orthogonal to both of the first and second directions, with one of the plurality of pressure chambers.

2. The liquid discharge head according to claim 1, wherein the first connecting channel overlaps, in the third direction, with a first pressure chamber which is included in the plurality of pressure chambers and which is arranged at one end in the first direction; and the second connecting channel overlaps, in the third direction, with a second pressure chamber which is included in the plurality of pressure chambers and which is arranged at the other end in the first direction.

3. The liquid discharge head according to claim 1, wherein the first connecting channel does not overlap, in the third direction, with a first pressure chamber which is included in the plurality of pressure chambers and which is arranged at one end in the first direction, and overlaps, in the third direction, with a second pressure chamber which is included in the plurality of pressure chambers and which is arranged closer to a side of the other end in the first direction relative to the first pressure chamber; and the second connecting channel does not overlap, in the third direction, with a third pressure chamber which is included in the plurality of pressure chambers and which is arranged at the other end in the first direction, and overlaps, in the third direction, with a fourth pressure chamber which is included in the plurality of pressure chambers and which is arranged closer to a side of the one end in the first direction relative to the third pressure chamber.

4. The liquid discharge head according to claim 2, wherein a plurality of dummy pressure chambers, which are included in the plurality of pressure chambers, are arranged on the one end and the other end of each of the plurality of pressure chambers, respectively, in the first direction.

5. The liquid discharge head according to claim 3, wherein a plurality of dummy pressure chambers, which are included in the plurality of pressure chambers, are arranged on the one end and the other end of each of the plurality of pressure chambers, respectively, in the first direction.

6. The liquid discharge head according to claim 1, wherein each of the first and second connecting channels extends in the second direction.

7. The liquid discharge head according to claim 1, wherein the first connecting channel has a supply port;

the second connecting channel has a return port; and the supply port and the return port are located, in the second direction, between the first and second pressure chamber groups.

8. The liquid discharge head according to claim 7, wherein a width of the first connecting channel becomes narrower as approaching closer to the supply port; and a width of the second connecting channel becomes narrower as approaching closer to the return port.

9. The liquid discharge head according to claim 8, wherein the return port is provided on an upper surface in the second connecting channel; and the width of the second connecting channel becomes narrower as approaching closer to an upper side.

10. The liquid discharge head according to claim 7, wherein the supply port and the return port are provided on surfaces in the first connecting channel and the second connecting channel, respectively, each of the surfaces being orthogonal to the third direction.

11. The liquid discharge head according to claim 10, wherein each of the supply port and the return port is provided, in the first direction, on an arrangement area in which the plurality of pressure chambers are arranged.

12. The liquid discharge head according to claim 10, wherein a wall which is provided on at least one of the one end in the first direction in the first common channel, the one end in the first direction in the second common channel, the other end in the first direction in the first common channel, and the other end in the first direction in the second common channel, and which is on a side opposite, in the third direction, to the supply port and the return port, is defined by a first guide surface; and the first guide surface is inclined so that the first guide surface is approaching closer, in the second direction, to the plurality of pressure chambers and as separating farther, in the third direction, from the supply port and the return port.

13. The liquid discharge head according to claim 12, wherein the plurality of pressure chambers include a plurality of normal pressure chambers and a dummy pressure chamber; and the first guide surface does not overlap, in the second direction, with one of the plurality of normal pressure chambers communicating with a common channel which is one of the first and second common channels and on which the first guide surface is provided.

14. The liquid discharge head according to claim 10, wherein a wall which is provided on one of the one end in the first direction in the first common channel, the one end in the first direction in the second common channel, the other end in the first direction in the first common channel, and the other end in the first direction in the second common channel, and which is on a side, in the third direction, of the supply port and the return port, is defined by a second guide surface; and the second guide surface is inclined so that the second guide surface is approaching closer, in the second direction, to the plurality of pressure chambers and as the second guide surface approaches closer, in the third direction, to the supply port and the return port.

15. The liquid discharge head according to claim 14, wherein the plurality of pressure chambers include a plurality of normal pressure chambers and a dummy pressure chamber; and the second guide surface does not overlap, in the second direction, with one of the plurality of normal pressure chambers communicating with a common channel which is one of the first and second common channels and on which the second guide surface is provided.

16. The liquid discharge head according to claim 1, wherein the third direction is a vertical direction; and a height of an upper surface of the first common channel, a height of an upper surface of the second common channel, a height of an upper surface of the first connecting channel, and a height of an upper surface of the second connecting channel are the same.

17. The liquid discharge head according to claim 1, wherein the third direction is a vertical direction; and a height of an upper surface of the first common channel and a height of an upper surface of the second common channel are the same; and a height of an upper surface of the first connecting channel and a height of an upper surface of the second connecting channel are the same, and are higher than the height of the upper surface of the first common channel and the height of the upper surface of the second common channel.

18. The liquid discharge head according to claim 1, further comprising:

a pressure chamber substrate including the plurality of pressure chambers;

an actuator substrate having a plurality of actuators which overlap, in the third direction, respectively with the plurality of pressure chambers, fixed to the pressure chamber substrate;

a protective substrate arranged at a position at which the protective substrate sandwiches, in the third direction, the actuator substrate between the pressure chamber substrate and the protective substrate, and covering the plurality of actuators; and a driving circuit electrically connected to the plurality of actuators and configured to supply a driving signal to the plurality of actuators, wherein the driving circuit extends in the first direction in a surface, in the protective substrate, which is on a side opposite to another surface, in the protective substrate, facing the plurality of actuators.

19. The liquid discharge head according to claim 18, further comprising a channel member formed with the first connecting channel and the second connecting channel, wherein the channel member is arranged at a position at which the channel member sandwiches, in the third direction, the actuator substrate, the protective substrate and the driving circuit between the pressure chamber substrate and the channel member.

* * * * *